US011235194B2

(12) United States Patent
Parker

(10) Patent No.: US 11,235,194 B2
(45) Date of Patent: Feb. 1, 2022

(54) MOBILE EXERCISE APPARATUS AND METHODS OF USING SAME

(71) Applicant: David Parker, Fairburn, GA (US)

(72) Inventor: David Parker, Fairburn, GA (US)

( * ) Notice: Subject to any disclaimer, the term of this patent is extended or adjusted under 35 U.S.C. 154(b) by 107 days.

(21) Appl. No.: 16/820,168

(22) Filed: Mar. 16, 2020

(65) Prior Publication Data

US 2021/0283458 A1 Sep. 16, 2021

(51) Int. Cl.

| | |
|---|---|
| ***A63B 21/00*** | (2006.01) |
| ***A63B 21/055*** | (2006.01) |
| ***A63B 21/04*** | (2006.01) |
| ***A63B 71/00*** | (2006.01) |

(52) U.S. Cl.

CPC .... *A63B 21/4033* (2015.10); *A63B 21/00069* (2013.01); *A63B 21/0442* (2013.01); *A63B 21/0552* (2013.01); *A63B 21/4009* (2015.10); *A63B 71/0036* (2013.01); *A63B 2208/0204* (2013.01); *A63B 2210/50* (2013.01)

(58) Field of Classification Search

CPC ..... A63B 21/4033; A63B 21/4009; A63B 21/00069; A63B 21/0442; A63B 21/0552; A63B 71/0036; A63B 2210/50; A63B 2208/0204; A63B 5/00–16

See application file for complete search history.

(56) References Cited

U.S. PATENT DOCUMENTS

| | | | | |
|---|---|---|---|---|
| 5,133,545 | A * | 7/1992 | Moschetti | A63B 21/015 482/110 |
| 6,030,321 | A * | 2/2000 | Fuentes | A63B 21/04 482/74 |
| 7,591,763 | B1 * | 9/2009 | Fucci | A63B 21/0552 482/121 |
| 7,951,054 | B2 * | 5/2011 | Snow | A63B 23/04 482/136 |
| 8,062,189 | B1 * | 11/2011 | Moring, Jr. | A63B 21/00047 482/53 |
| 8,465,399 | B2 * | 6/2013 | Tommy, Jr. | A63B 21/0442 482/53 |
| 9,259,604 | B2 | 2/2016 | Miller | |
| 9,375,607 | B1 | 6/2016 | Rayman | |
| 9,457,219 | B2 | 10/2016 | Smith | |
| 9,616,274 | B2 * | 4/2017 | Wehrell | A63B 21/4009 |
| 9,649,522 | B2 * | 5/2017 | Wyatt | A63B 21/00043 |
| 9,662,536 | B1 | 5/2017 | Lin | |
| 10,220,233 | B2 | 3/2019 | Schmidt | |
| 10,792,532 | B1 * | 10/2020 | Hall | A63B 21/4009 |
| 2005/0130814 | A1 * | 6/2005 | Nitta | A63B 21/055 482/121 |
| 2006/0199706 | A1 * | 9/2006 | Wehrell | A63B 21/4019 482/92 |

(Continued)

*Primary Examiner* — Andrew S Lo
(74) *Attorney, Agent, or Firm* — Ballard Spahr LLP

(57) ABSTRACT

Described herein is a mobile exercise apparatus and methods of using the same. The mobile exercise apparatus may include a standing platform, a resistance mechanism, and a user engagement member. The user engagement member may engage hips of a user and the resistance mechanism. Engagement of the resistance mechanism by the user engagement member may cause the resistance mechanism to move within a path of travel of the standing platform toward a first end of the standing platform.

14 Claims, 9 Drawing Sheets

(56) References Cited

U.S. PATENT DOCUMENTS

| | | | | |
|---|---|---|---|---|
| 2007/0270294 | A1* | 11/2007 | Sheets | A63B 22/14 482/140 |
| 2008/0064520 | A1* | 3/2008 | Rushe | A63B 69/0059 473/224 |
| 2009/0111660 | A1* | 4/2009 | Snow | A63B 23/08 482/38 |
| 2009/0239720 | A1* | 9/2009 | Osbak | A63B 23/03525 482/112 |
| 2012/0065033 | A1* | 3/2012 | Moring, Jr. | A63B 21/00047 482/92 |
| 2015/0141219 | A1* | 5/2015 | Bellevue | A63B 21/00047 482/130 |
| 2015/0165259 | A1* | 6/2015 | Huppee | A63B 21/0442 482/99 |
| 2016/0296785 | A1* | 10/2016 | Kamins | A63B 21/4034 |
| 2016/0346601 | A1* | 12/2016 | Marcandelli | A61B 5/11 |
| 2017/0333744 | A1* | 11/2017 | Chapman | A63B 21/0442 |
| 2018/0078806 | A1* | 3/2018 | Samtani | A63B 21/0557 |
| 2018/0117396 | A1* | 5/2018 | Engelfried, Jr. | A63B 21/4035 |
| 2020/0009417 | A1* | 1/2020 | Dalebout | A63B 21/4043 |
| 2020/0038704 | A1* | 2/2020 | Adams | A63B 21/4035 |

* cited by examiner

MOBILE EXERCISE APPARATUS AND METHODS OF USING SAME

BACKGROUND

Squat-type exercises are useful for developing hip, abdominal, anterior and posterior strength. Oftentimes, these exercises are carried out using weight-loaded barbells that are positioned on person's back or shoulders. These weight-loaded barbells are often placed onto a squat rack or other similar device. While such weight-loaded barbells and squat racks may be beneficial for building strength, they are not portable and often require a large space for use and storage. These and other considerations are described herein.

SUMMARY

It is to be understood that both the following general description and the following detailed description are exemplary and explanatory only and are not restrictive. Described herein is an exercise apparatus and methods of using the same. The exercise apparatus may include a standing platform, a resistance mechanism, and a user engagement member. The standing platform may include a support bar that a user of the exercise apparatus may grasp for support before, during, or after use of the exercise apparatus. The user engagement member may engage hips of the user and the resistance mechanism. Engagement of the resistance mechanism by the user engagement member may cause the resistance mechanism to move within a path of travel of the standing platform toward a first end of the standing platform.

The standing platform may include wheels and a collapsible support bar, thereby enabling the exercise apparatus to be mobile easily stored. Further, the exercise apparatus may generate resistance at the resistance mechanism via at least one resistance band and/or at least one tension coil. The at least one resistance band may be mounted at an open channel of the standing platform. The at least one resistance band may also be mounted at either side of the standing platform. The at least one tension coil may be adjustable via a rotatable mechanism of the support handle.

Additional advantages will be set forth in part in the description which follows or may be learned by practice. The advantages will be realized and attained by means of the elements and combinations particularly pointed out in the appended claims.

BRIEF DESCRIPTION OF THE DRAWINGS

The accompanying drawings, which are incorporated in and constitute a part of this specification, illustrate embodiments and together with the description, serve to explain the principles of the present apparatuses and methods of using the same described herein.

DETAILED DESCRIPTION

Figure 1:
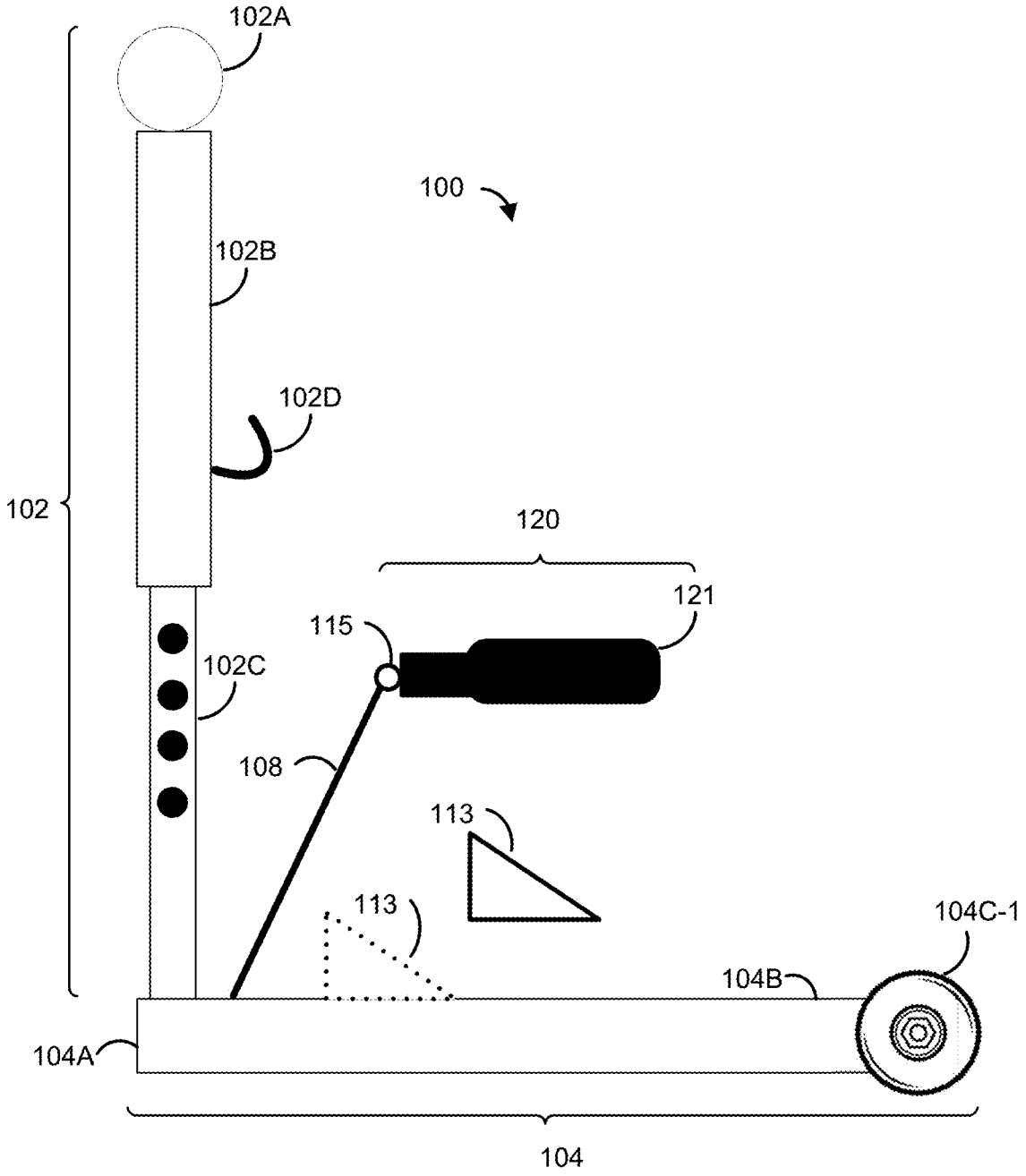
FIG. 1 shows a profile view of an example exercise apparatus.

Before the present apparatuses and methods of using the same are described, it is to be understood that the present apparatuses and methods of using the same are not limited to specific methods, specific components, or to particular implementations. It is also to be understood that the terminology used herein is not intended to be limiting.

As used in the specification and the appended claims, the singular forms "a," "an," and "the" include plural referents unless the context clearly dictates otherwise. Ranges may be expressed herein as from "about" one particular value, and/or to "about" another particular value. When such a range is expressed, another range includes from the one particular value and/or to the other particular value. Similarly, when values are expressed as approximations, by use of the antecedent "about," it will be understood that the particular value forms another value or range. It will be further understood that the endpoints of each of the ranges are significant both in relation to the other endpoint, and independently of the other endpoint.

"Optional" or "optionally" means that the subsequently described event or circumstance may or may not occur, and that the description includes cases where said event or circumstance occurs and cases where it does not. Throughout the description and claims of this specification, the word "comprise" and variations of the word, such as "comprising" and "comprises," means "including but not limited to," and is not intended to exclude other components, integers or steps. "Such as" is not used in a restrictive sense, but for explanatory purposes.

Described herein are components that may be used to perform the described methods and apparatuses. These and other components are described herein, and it is understood that when combinations, subsets, interactions, groups, etc. of these components are described that while specific reference of each various individual and collective combinations and permutations of these may not be explicitly described, each is specifically contemplated and described herein, for all methods and apparatuses. This applies to all parts of this application including, but not limited to, steps in described methods. Thus, if there are a variety of additional steps that may be performed, it is understood that each of these additional steps may be performed with any combination or permutation of the described methods. The present methods and apparatuses may be understood more readily by reference to the following detailed description and to the Figures and their previous and following description.

Described herein is an exercise apparatus and methods of using the same. The exercise apparatus may include a standing platform having a first end, a second end, a first side, a second side, and an open channel. The standing platform may include a first wheel and a second wheel. The first wheel may be fastened to the first side of the standing platform substantially near the second end of the standing platform. The second wheel may be fastened to the second side of the standing platform substantially near the second end of the standing platform. The open channel of the standing platform may partially bisect the standing platform. The open channel of the standing platform may be situated parallel to the first side and the second side of the standing platform.

The exercise apparatus may include a collapsible member having a distal end and a proximal end. The collapsible member may include a support handle fastened to the distal end that a user of the exercise apparatus may grasp for support before, during, or after use of the exercise apparatus. The proximal end of the collapsible member may be situated at the first end of the standing platform. The proximal end of the collapsible member may include a pivot point. The pivot point may allow the collapsible member to pivot toward the second end of the standing platform and be placed at least partially into the open channel of the standing platform when storing or moving the exercise apparatus. The collapsible member may also include a top portion at the proximal end and a bottom portion at the distal end. The bottom portion of the collapsible member may collapse into the top portion of the collapsible member, thereby enabling the user to adjust a height of the collapsible member.

The exercise apparatus may include a resistance mechanism. In a first example configuration of the exercise apparatus, the resistance mechanism may be situated partially within the open channel and partially within an interior path of travel of the standing platform. The resistance mechanism may include a first plurality of elongate ends accessible at the open channel. The first plurality of elongate ends may be configured for mounting of a first resistance band. The resistance mechanism may include a second plurality of elongate ends accessible at the open channel. The second plurality of elongate ends may be configured for mounting of a second resistance band. In a second example configuration of the exercise apparatus, the resistance mechanism may have at least one tension coil. The support handle of the collapsible member may have a rotatable mechanism for adjustment an amount of resistance generated by the at least one tension coil. For example, the rotatable mechanism may be rotated in a first direction to increase the amount of resistance generated by the at least one tension coil. As another example, the rotatable mechanism may be rotated in a second direction to decrease the amount of resistance generated by the at least one tension coil.

The exercise apparatus may include a user engagement member having a first portion for engaging hips of a user and a second portion for engaging the resistance mechanism. The first portion of the user engagement member may be a belt, such as a weight-lifting belt, or other supporting apparatus. The second portion of the user engagement member may be a connecting implement, such as a carabineer or the like. The user engagement member may engage the resistance mechanism via a cord fastened at a first end to the second portion of the user engagement member and fastened at a second end to the resistance mechanism. Before or after use of the exercise apparatus, the user may place the user engagement member at a mounting point of the collapsible member. The mounting point may be, for example, a hook or the like. Placement of the user engagement member at the mounting point may partially engage the resistance mechanism and cause the resistance mechanism to move within the path of travel toward the first end of the standing platform and partially engage the resistance bands.

When ready to use the exercise apparatus, the user may place the second portion of the user engagement member on the mounting point and engage (e.g., depress) a button of the support handle in order to cause the top portion of the collapsible member to slide over the bottom portion of the collapsible member to lower the height of the collapsible member. In this way, the resistance mechanism may become disengaged to allow the user to mount one more resistance bands and/or to adjust an amount of resistance generated by the at least one tension coil. The user may then engage (e.g., depress) the button of the support handle in order to cause the top portion of the collapsible member to slide out of the bottom portion of the collapsible member to raise the height of the collapsible member.

The user may then wrap the first portion of the user engagement member around his or her waist or midsection. When wrapping the first portion of the user engagement member around his or her waist or midsection, the user may be partially squatting. The user may then stand upright. When standing upright, the user may cause the second portion of the user engagement member to be removed from the mounting point. In this way, the user may stand upright and cause the resistance mechanism to remain engaged via the cord fastened to the user engagement member at the first end and fastened to the resistance mechanism at the second end. The user may then move into a squatting position. When in the squatting position, the resistance mechanism may be partially engaged or unengaged by the user engagement member.

The user may move from the squatting position to a standing position. When the user moves into the standing position, the resistance mechanism may be caused to be engaged to generate an amount of resistance to enable the user of the exercise apparatus to exercise hip, abdominal, anterior, and posterior muscles.

Figure 2A:
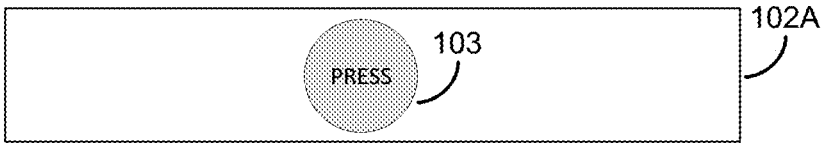
FIG. 2A shows an overhead view of an example exercise apparatus component.
Figure 2B:
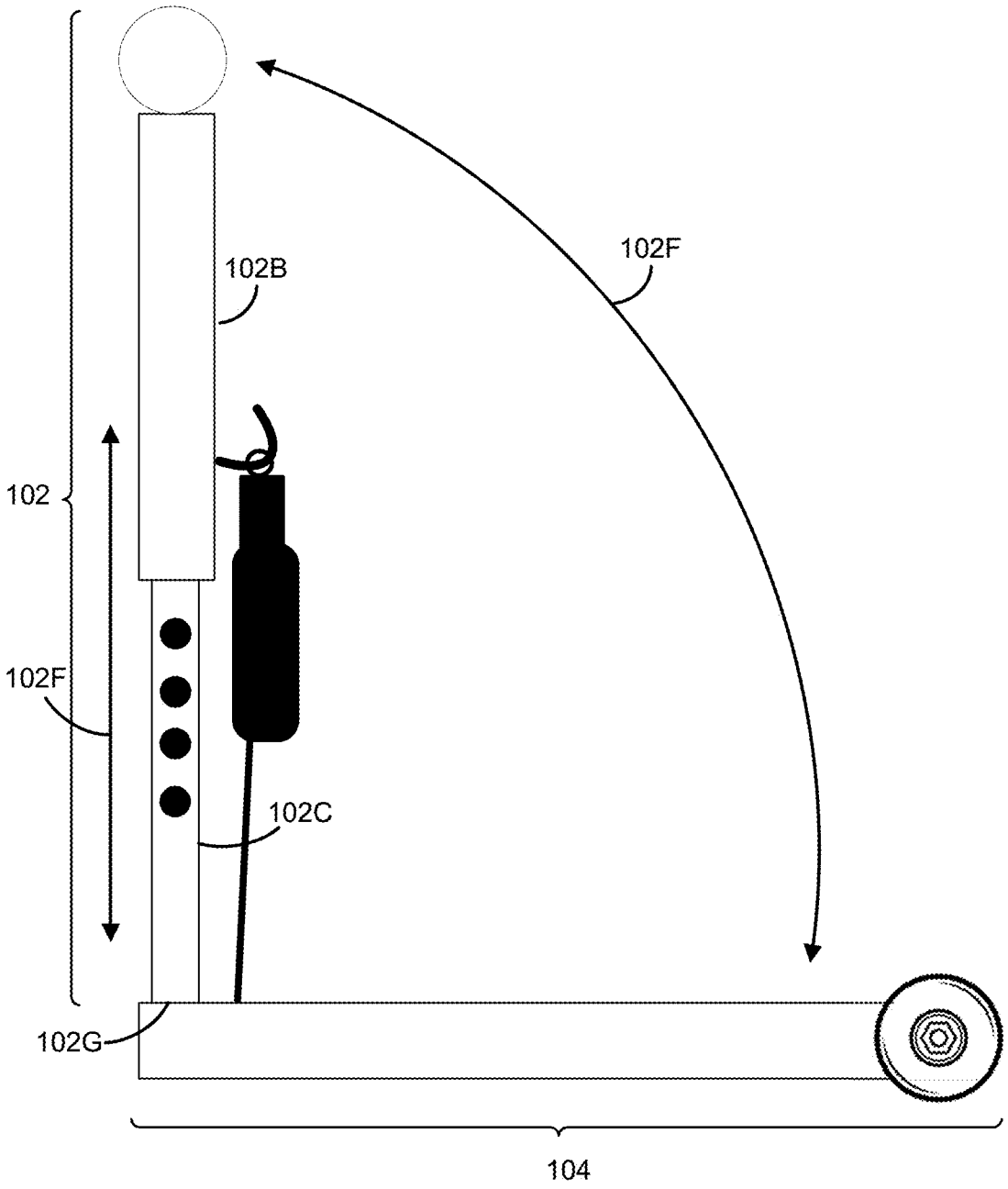
FIG. 2B shows a profile view of an example exercise apparatus.
Figure 3:
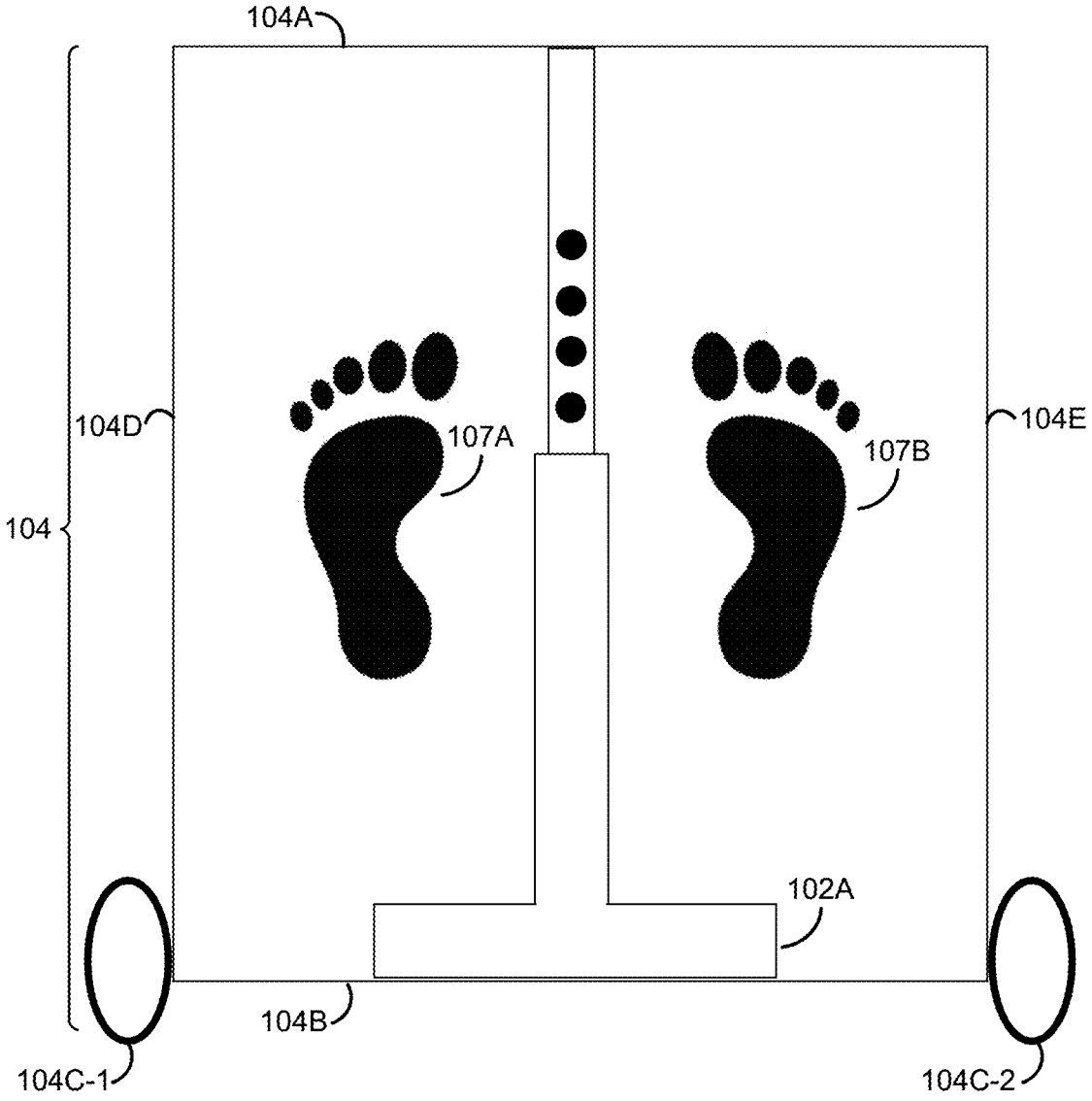
FIG. 3 shows an overhead view of an example exercise apparatus.

Turning now to FIGS. 1-6, an example exercise apparatus 100 is shown. FIG. 1 shows a profile view of the exercise apparatus 100. The exercise apparatus 100 may include a standing platform 104. As further described herein with respect to FIGS. 7 and 8, a user of the exercise apparatus 100 may stand upon the standing platform 104 and perform one or more exercise. As shown in FIG. 3, the standing platform 104 may have a first end 104A, a second end 104B, a first side 104D, and a second side 104E. Returning to FIG. 1, the exercise apparatus 100 may include a collapsible member 102 having a distal end and a proximal end. The collapsible member 102 may include a support handle 102A fastened to the distal end that a user of the exercise apparatus 100 may grasp for support before, during, or after use of the exercise apparatus 100. The collapsible member 102 may also include a top portion 102B at the proximal end and a bottom portion 102C at the distal end.

Figure 4A:
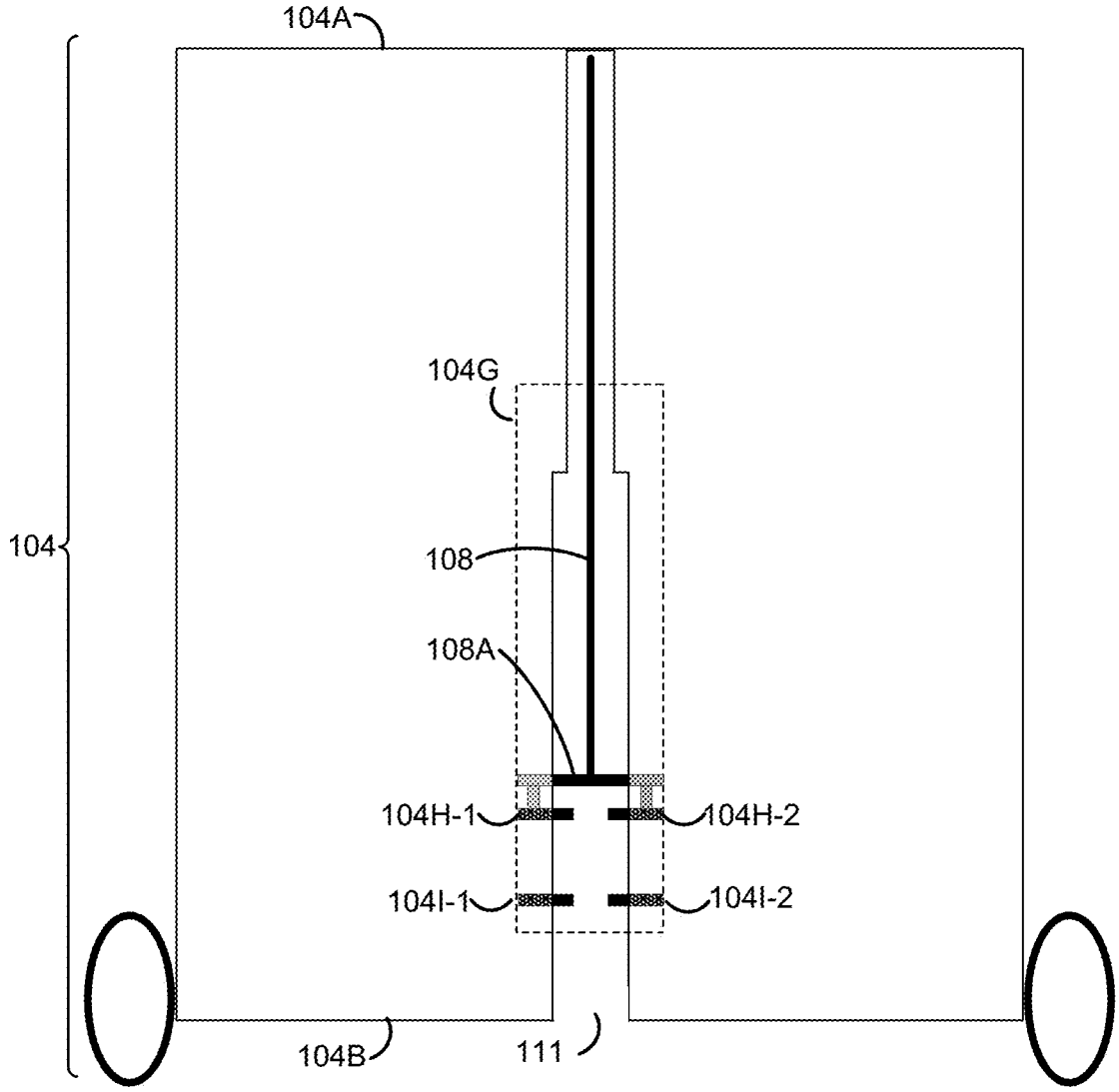
FIG. 4A shows an overhead view of an example exercise apparatus.
Figure 4B:
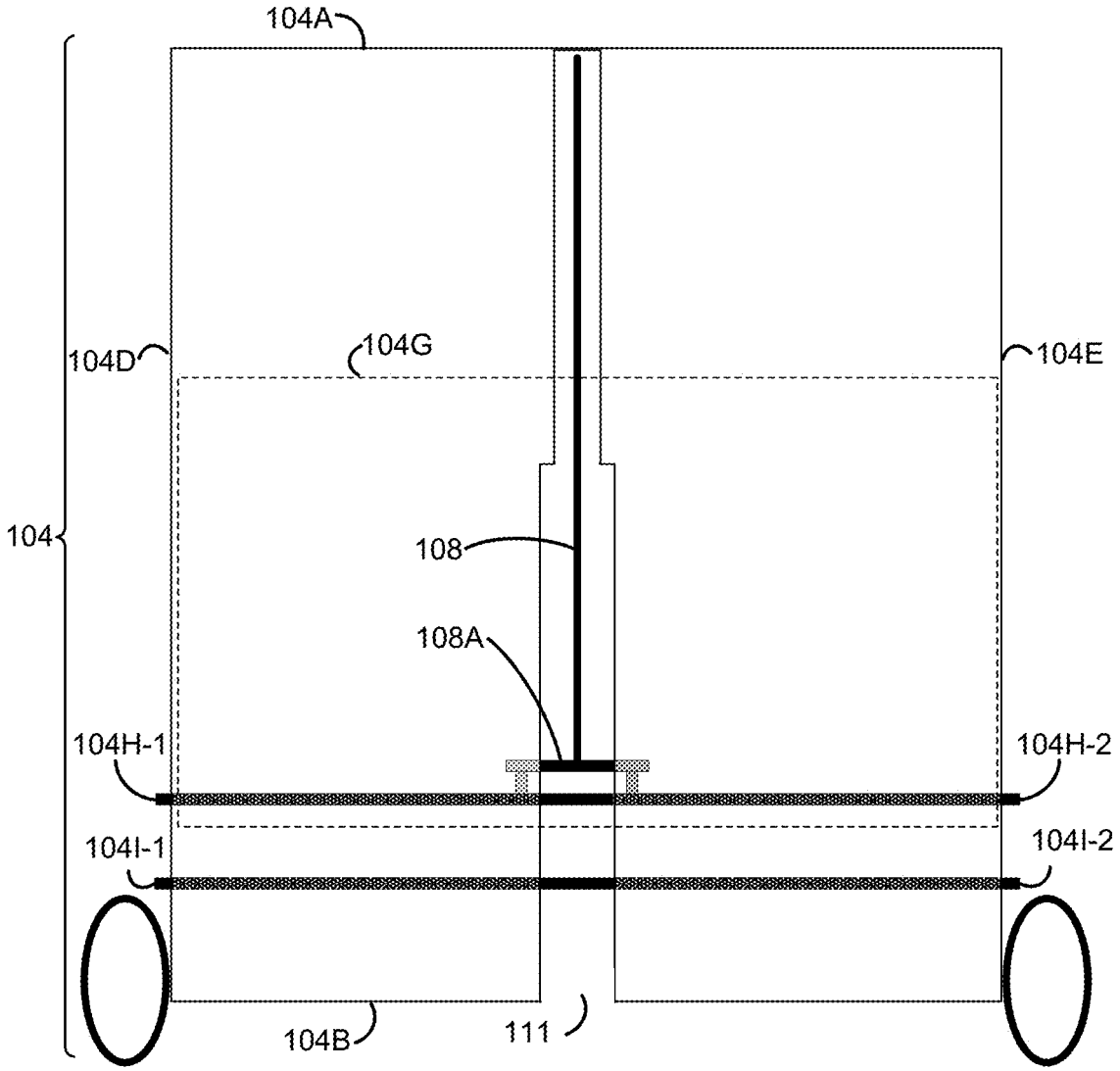
FIG. 4B shows an overhead view of an example exercise apparatus.

FIG. 2A shows an overhead view of the support handle 102A of the exercise apparatus 100. The support handle 102A have a button 103, or other implement, that when engaged (e.g., depressed) by a user causes the top portion 102 of the collapsible member 102 to slide over the bottom portion 102C of the collapsible member 102 to adjust a height of the collapsible member 102. For example, FIG. 2B shows a direction 102F in which the collapsible member 102 may move when the button 103 is engaged. In this way, the bottom portion 102C of the collapsible member 102 may collapse (e.g., slide) into the top portion 102B of the collapsible member 102, thereby enabling the user to adjust a height of the collapsible member 102. The proximal end of the collapsible member 102 may be situated at the first end 104A of the standing platform 104. The proximal end of the collapsible member 102 may include a pivot point 102G. The pivot point 102G may include a locking mechanism (not shown) that engages the standing platform 104 so as to keep the collapsible member 102 from moving. The locking mechanism of the pivot point 102G may be engaged or disengaged by a user engaging (e.g., depressing) the button 103. The pivot point 102G may allow the collapsible member 102 to pivot toward the second end 104B of the standing platform 104 in a direction of travel 102F and be placed at least partially into an open channel 111 of the standing platform 104, which is shown in FIGS. 4A and 4B. For example, a user of the exercise apparatus 100 may engage the button 103 to disengage the locking mechanism of the pivot point 102G when storing or moving the exercise apparatus 100. Engagement of the button 103 may cause the locking mechanism of the pivot point 102G to disengage and the collapsible member 102 to pivot at the pivot point 102G in the direction of travel 102F toward the standing platform 104.

Returning to FIG. 1, the exercise apparatus 100 may further include a removable stance adjustment implement 113. The removable stance adjustment implement 113 may be, for example, a wedge or other implement for placement under the feet of a user to adjust his or her stance. The removable stance adjustment implement 113 may be placed on the standing platform 104 at a desired position by a user of the exercise apparatus 100 to adjust his or her stance when using the exercise apparatus 100.

The exercise apparatus 100 may include a user engagement member 120 having a first portion 121 for engaging the hips of a user of the exercise apparatus 100 and a second portion 115 for engaging a resistance mechanism 108A of the exercise apparatus 100, which is described further herein. The first portion 121 of the user engagement member 120 may be a belt, such as a weight-lifting belt, or other supporting apparatus. A user of the exercise apparatus 100 may wrap the first portion 121 around his or her waist or midsection. The second portion 115 of the user engagement member 120 may be a connecting implement, such as a carabineer or the like. The user engagement member 120 may engage the resistance mechanism 108A, which is shown in FIGS. 4A and 4B, via a cord 108 fastened at a first end to the second portion 115 of the user engagement member 120 and fastened at a second end to the resistance mechanism 108A. Before or after use of the exercise apparatus 100, the user may place the user engagement member 120 at a mounting point 102D of the collapsible member 102. The mounting point 102D may be, for example, a hook or the like.

Turning now to FIG. 3, an overhead view of the exercise apparatus is shown. The standing platform 104 may include a first wheel 105C-1, which is also shown in FIG. 1, and a second wheel 105C-2. The first wheel 105C-1 may be fastened to the first side 104D of the standing platform 104 substantially near the second end 104B of the standing platform 104. The second wheel 105C-2 may be fastened to the second side 104E of the standing platform 104 substantially near the second end 104B of the standing platform 104. The standing platform 104 may include a left foot placement indicator 107A and a right foot placement indicator 107B for assisting a user of the exercise apparatus 100 with proper placement of his or her feet on the standing platform 104. As an example, a user of the exercise apparatus 100 may place a first removable stance adjustment implement 113 at the left foot placement indicator 107A and a second removable stance adjustment implement 113 at the right foot placement indicator 107B. Other locations on the standing platform 104 for placement of the first and the second removable stance adjustment implements 113 are possible as well. As described above, the pivot point 102G of the collapsible member 102 may allow the collapsible member 102 to pivot toward the second end 104B of the standing platform 104 in the direction of travel 102F and be placed at least partially into the open channel 111 of the standing platform 104. FIG. 3 shows a position of the collapsible member 102 and the support handle 102A when placed at least partially into the open channel 111 of the standing platform 104.

Turning now to FIG. 4A, an overhead view of the exercise apparatus is shown. The open channel 111 of the standing platform 104 may partially bisect the standing platform 104. The open channel 111 of the standing platform 104 may be situated parallel to the first side 104D and the second side 104E of the standing platform 104. As described herein, the exercise apparatus 100 may include a resistance mechanism 108A. In a first example configuration of the exercise apparatus 100, as shown in FIG. 4A, the resistance mechanism 108A may be fastened to the cord 108 and situated partially within the open channel 111 and partially within an interior path of travel 104G of the standing platform 104. The interior path of travel 104G may allow the resistance mechanism 108A to slide toward the first end 104A when a user engages the cord 108 and to slide toward the second end 104B when the user disengages the cord 108. The resistance mechanism 108A may include a first plurality of elongate ends 104H accessible at the open channel 111. As shown in FIG. 4A, a first elongate end 108H-1 of the first plurality of elongate ends 104H may be accessible at a first side of the open channel 111. As also shown in FIG. 4A, a second elongate end 108H-2 of the first plurality of elongate ends 104H may be accessible at a second side of the open channel 111. The resistance mechanism 108A may include a second plurality of elongate ends 104I accessible at the open channel 111.

Figure 5A:
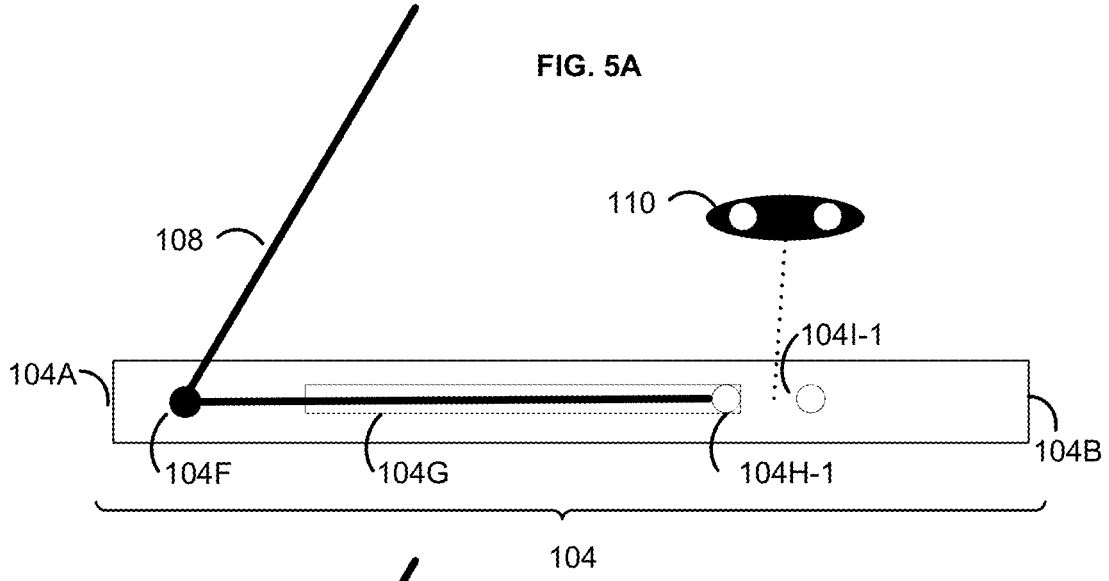
FIG. 5A shows a cutaway view of an example exercise apparatus.
Figure 5B:
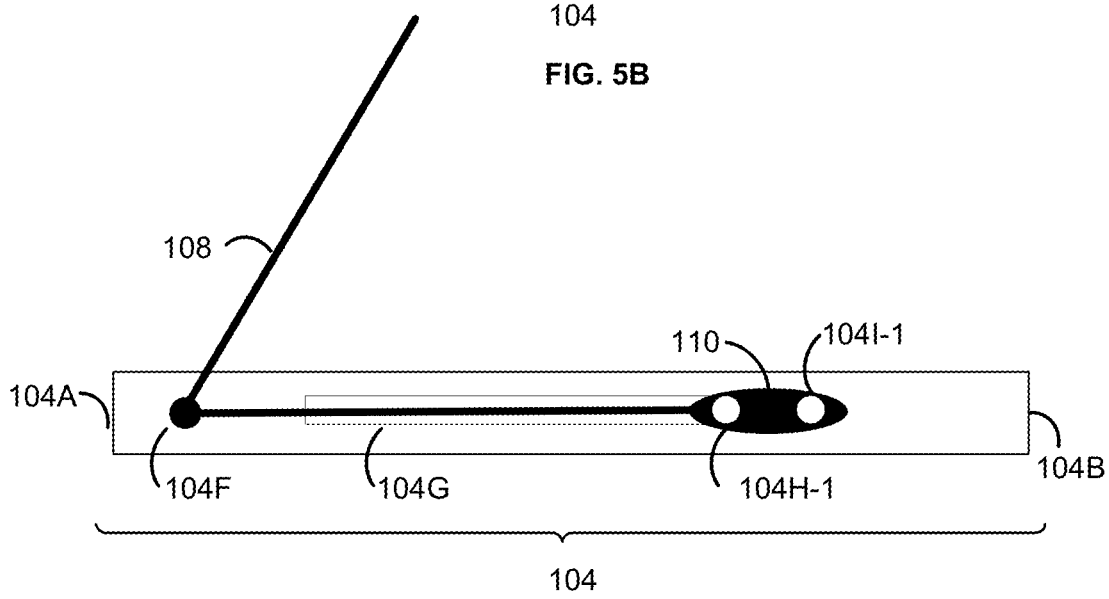
FIG. 5B shows a cutaway view of an example exercise apparatus.
Figure 5C:
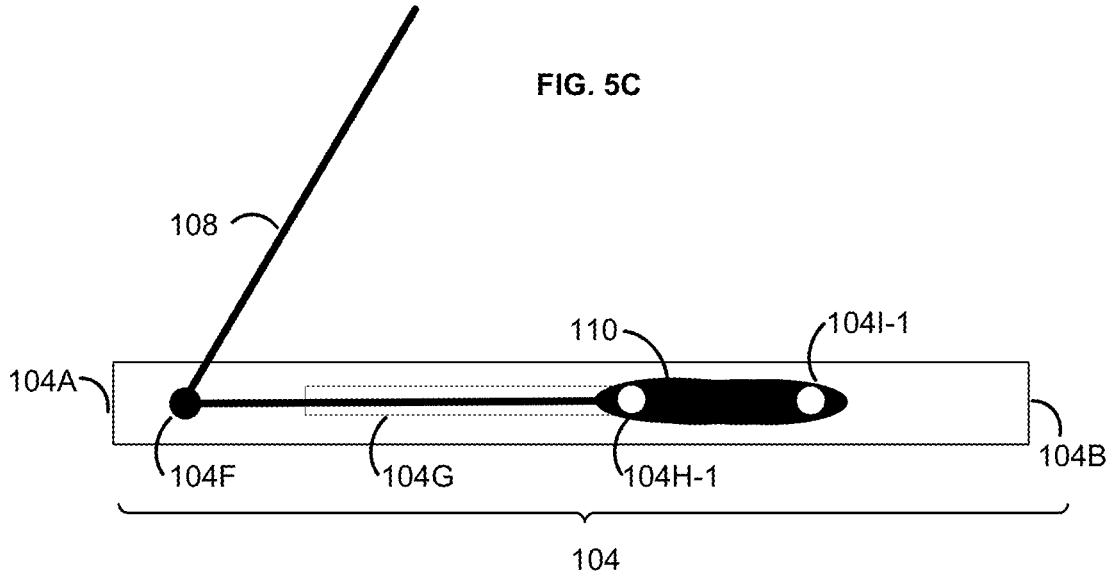
FIG. 5C shows a cutaway view of an example exercise apparatus.

As shown in FIG. 4A, a first elongate end 108I-1 of the second plurality of elongate ends 104I may be accessible at the first side of the open channel 111. As also shown in FIG. 4A, a second elongate end 108I-2 of the second plurality of elongate ends 104I may be accessible at the second side of the open channel 111. The first plurality of elongate ends 104H and the second plurality of elongate ends 104I may be configured for mounting of one or more resistance bands 110, which are shown in FIGS. 5A-5C. For example, the first elongate end 104H-1 may be configured for mounting of a first opening of a first resistance band 110, and the first elongate end 104I-1 may be configured for mounting of a second opening of the first resistance band 110. As another example, the second elongate end 104H-2 may be configured for mounting of a first opening of a second resistance band 110, and the second elongate end 104I-2 may be configured for mounting of a second opening of the second resistance band 110.

Turning now to FIG. 4B, an overhead view of the exercise apparatus is shown. FIG. 4B shows another example configuration of the exercise apparatus 100 and the resistance mechanism 108A. As shown in FIG. 4B, the resistance mechanism 108A may be situated partially within the open channel 111 and partially within the interior path of travel 104G of the standing platform 104. The interior path of travel 104G according to the example configuration of the resistance mechanism 108A shown in FIG. 4B may be wider than the configuration shown in FIG. 4A. Further, in the example configuration of the resistance mechanism 108A shown in FIG. 4B, the first plurality of elongate ends 104H may be accessible at the first side 104D of the standing platform 104, and the second plurality of elongate ends 104I may be accessible at the second side 104D of the standing platform 104. In this way, one or more resistance bands 110 may be mounted at the sides of the standing platform 104 rather than at the open channel 111 of the standing platform 104.

As shown in FIG. 4B, the first elongate end 108H-1 of the first plurality of elongate ends 104H may be accessible at the first side 104D of the standing platform 104, and the second elongate end 108H-2 of the first plurality of elongate ends 104H may be accessible at the second side 104D of the standing platform 104. As also shown in FIG. 4B, the first elongate end 108I-1 of the second plurality of elongate ends 104I may be accessible at the first side 104D of the standing platform 104, and the second elongate end 108I-2 of the second plurality of elongate ends 104I may be accessible at the second side 104D of the standing platform 104 The first plurality of elongate ends 104H and the second plurality of elongate ends 104I may be configured for mounting of one or more resistance bands 110. Similar to the configuration depicted in FIG. 4A, the first elongate end 104H-1 as shown in the configuration depicted in FIG. 4B may be configured for mounting of a first opening of a first resistance band 110, and the first elongate end 104I-1 may be configured for mounting of a second opening of the first resistance band 110. Additionally, the second elongate end 104H-2 may be configured for mounting of a first opening of a second resistance band 110, and the second elongate end 104I-2 may be configured for mounting of a second opening of the second resistance band 110.

In either of the configurations shown in FIGS. 4A and 4B, engagement of the resistance mechanism 108A by the user engagement member 120 and the cord 108 may cause the resistance mechanism 108A to move within the path of travel 104G of the standing platform 104 toward the first end 104A of the standing platform 104. In this way, engagement of the resistance mechanism 108A by the user engagement member 120 may generate an amount of resistance to enable the user of the exercise apparatus 100 to exercise hip, abdominal, anterior, and posterior muscles. Further, in either of the configurations shown in FIGS. 4A and 4B, more than one resistance band 110 may be used in a stacked configuration to increase an amount resistance experienced by the user. Further, multiple types of resistance bands 110 may be used, and each type may have a differing thickness based on a desired amount of resistance. For example, a resistance band 110 may consist of a rubberized materials that may stretch as force is applied in a lateral direction.

Turning now to FIGS. 5A-5C, cutaway views of the standing platform 104 of the exercise apparatus 100 are shown. As described herein, the resistance mechanism 108A may have a first configuration as shown in FIG. 4A or a second configuration as shown in FIG. 4B. The functionality of the exercise apparatus 100 and the resistance mechanism 108A as described with reference to FIGS. 5A-5C may apply equally to either of the configurations of the resistance mechanism 108A as shown in FIGS. 4A and 4B. For ease of understanding, FIGS. 5A-5C show only the first elongate end 104H-1 and the first elongate end 104I-1. It is to be understood that the functionality of the first elongate end 104H-1 and the first elongate end 104I-1 as described with reference to FIGS. 5A-5C may apply equally to the second elongate end 104H-2 and the second elongate end 104I-2.

As shown in FIG. 5A, a first opening of a resistance band 110 may be mounted at the first elongate end 104H-1 and a second opening of the resistance band 110 may be mounted at the first elongate end 104I-1. FIG. 5B shows the resistance band 110 mounted at the first elongate end 104H-1 and the first elongate end 104I-1. As described herein, engagement of the resistance mechanism 108A by the user engagement member 120 and the cord 108 may cause the resistance mechanism 108A to move within the path of travel 104G of the standing platform 104 toward the first end 104A of the standing platform 104. For example, engagement of the resistance mechanism 108A by the user engagement member 120 and the cord 108 may cause the cord 108 to be pulled in an outward direction away from the standing platform 104. The cord 108 may move within the standing platform in a channel and along a roller 104F, or similar mechanism, for converting an upward angle of force generated by engagement of the user engagement member 120 into a lateral force to be applied to the resistance mechanism 108A. FIG. 5C shows a result of engagement of the resistance mechanism 108A by the user engagement member 120 and the cord 108. As shown in FIG. 5C, the resistance band 110 may be caused to stretch laterally, thereby generating an amount of resistance to enable a user of the exercise apparatus 100 to exercise hip, abdominal, anterior, and posterior muscles.

As described herein, before or after use of the exercise apparatus 100, a user may place the user engagement member 120 at the mounting point 102D of the collapsible member 102. Placement of the user engagement member 120 at the mounting point 102D may partially engage the resistance mechanism 108A and cause the resistance mechanism 108A to move within the path of travel 104G toward the first end 104A of the standing platform 104 and partially engage the one or more resistance bands 110.

Figure 6A:
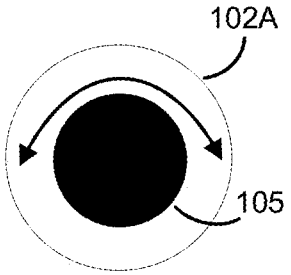
FIG. 6A shows a profile view of an example exercise apparatus.
Figure 6B:
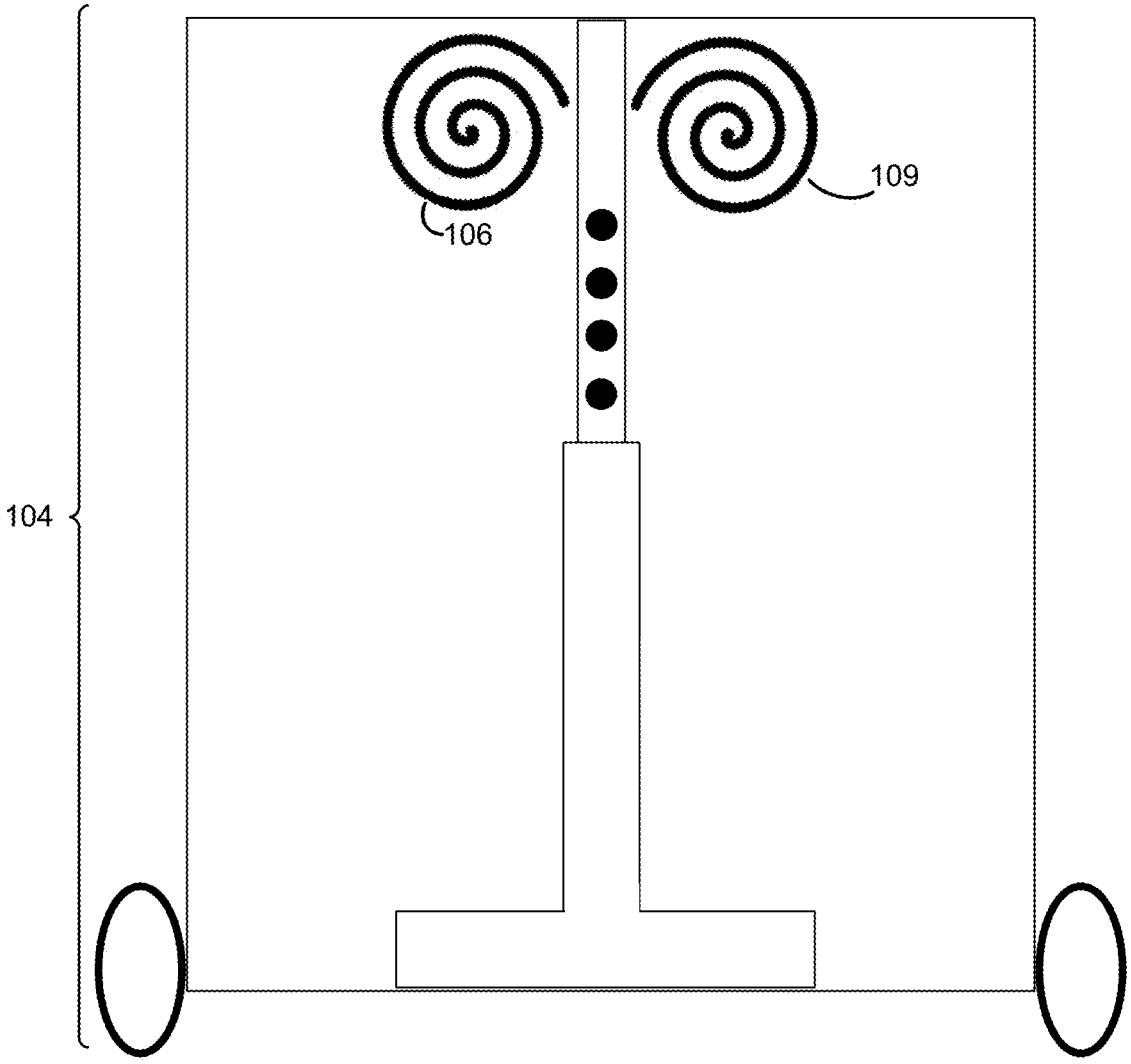
FIG. 6B shows an overhead view of an example exercise apparatus.

Turning now to FIGS. 6A and 6B, a profile view of the support handle 102A of the collapsible member 102 is shown in FIG. 6A and an overhead view of the exercise apparatus 100 is shown in FIG. 6B. In an example configuration of the exercise apparatus 100, the resistance mechanism 108A may include at least one tension coil 106,109 instead of, or in addition to, the one or more resistance bands 110. As shown in FIG. 6A, the support handle 102A of the collapsible member 102 may have a rotatable mechanism 105 for adjustment an amount of resistance generated by the at least one tension coil 106,109. For example, the rotatable mechanism 105 may be rotated in a first direction to increase the amount of resistance generated by the at least one tension coil 106,109. As another example, the rotatable mechanism 105 may be rotated in a second direction to decrease the amount of resistance generated by the at least one tension coil 106,109.

Figure 7:
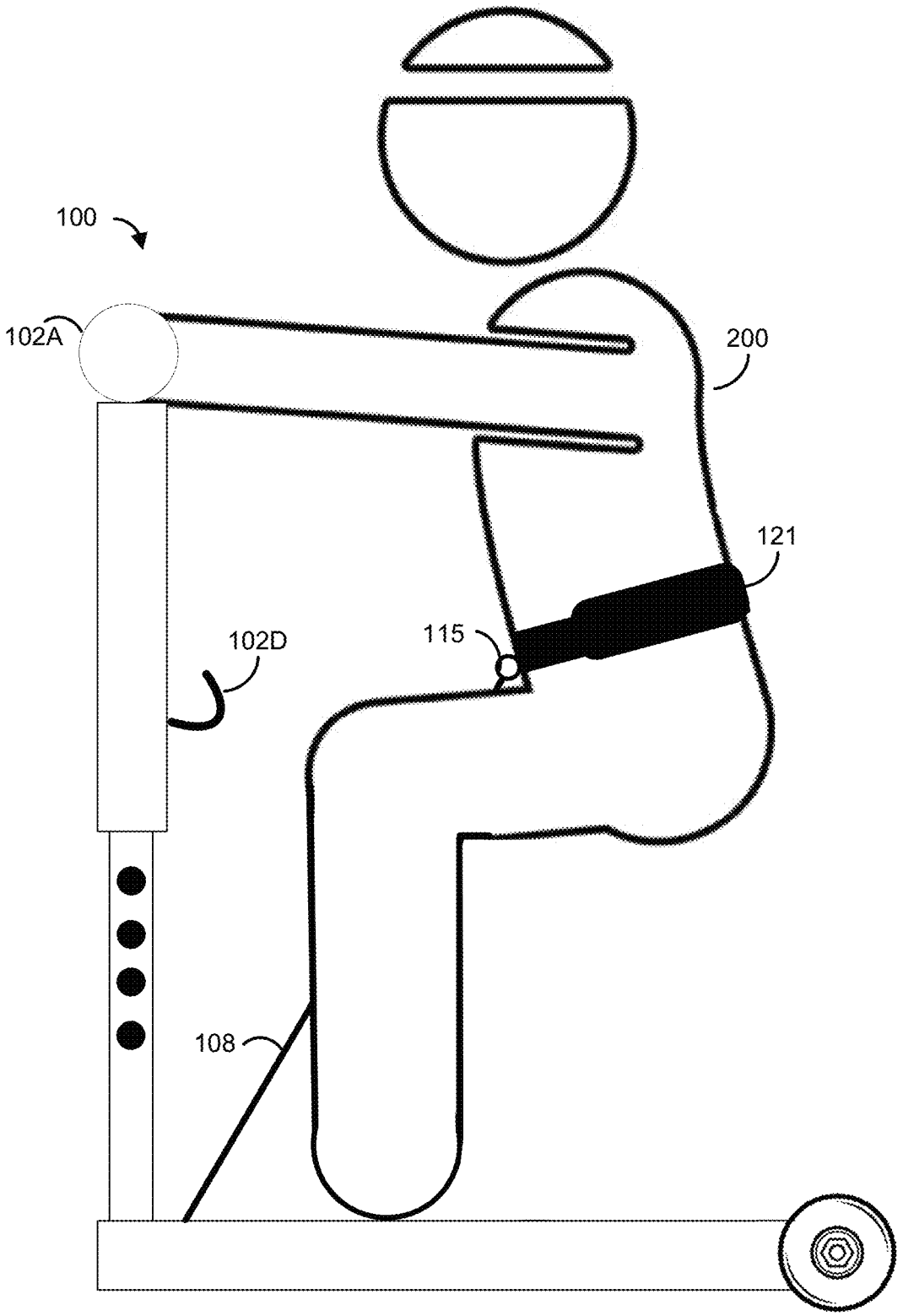
FIG. 7 shows a profile view of an example exercise apparatus.
Figure 8:
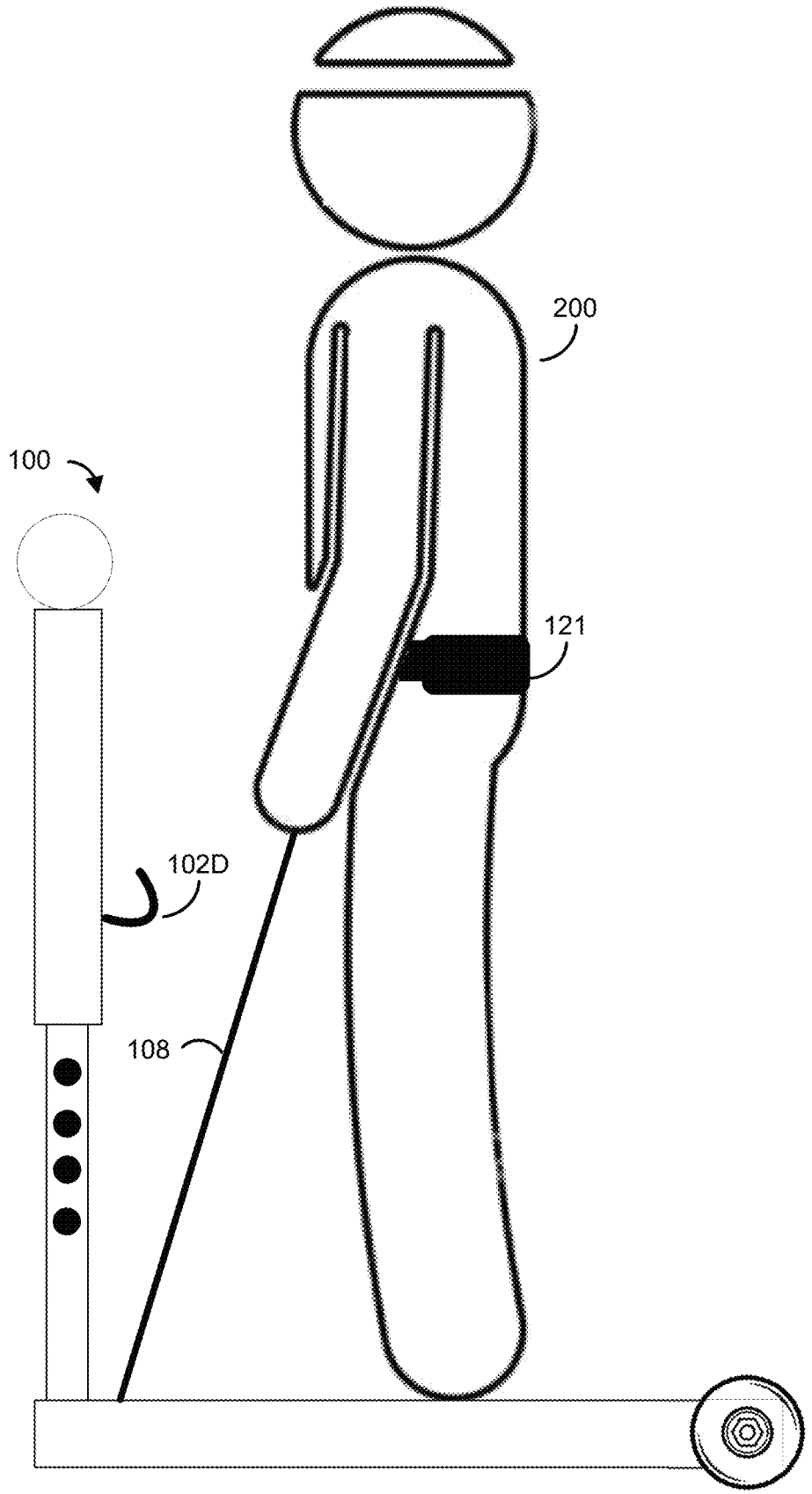
FIG. 8 shows a profile view of an example exercise apparatus.

Turning now to FIGS. 7 and 8, profile views of the exercise apparatus 100 and a user 200 of the exercise apparatus 100 are shown. When ready to use the exercise apparatus 100, the user 200 of the exercise apparatus 100 may place the second portion 115 of the user engagement member 120 on the mounting point 102D and engage (e.g., depress) the button 103 of the support handle 102A in order to cause the top portion 102 of the collapsible member 102 to slide over the bottom portion 102C of the collapsible member 102 to lower the height of the collapsible member 102. In this way, the resistance mechanism 108A may become disengaged to allow the user 200 to mount one more resistance bands 110 and/or to adjust an amount of resistance generated by the at least one tension coil 106,109. The user 200 may then engage (e.g., depress) the button 103 of the support handle 102A in order to cause the top portion 102 of the collapsible member 102 to slide out of the bottom portion 102C of the collapsible member 102 to raise the height of the collapsible member 102. In this way, the resistance mechanism 108A may become engaged.

The user 200 may then wrap the first portion 121 of the user engagement member 120 around his or her waist or midsection. When wrapping the first portion 121 of the user engagement member 120 around his or her waist or midsection, the user 200 may be partially squatting. The user 200 may then stand upright. When standing upright after wrapping the first portion 121 of the user engagement member 120 around his or her waist or midsection, the user 200 may cause the second portion 115 of the user engagement member 120 to be removed from the mounting point 102D. In this way, the user 200 may stand upright and cause the resistance mechanism 108A to remain engaged via the cord 108 fastened to the user engagement member 120 at the first end and fastened to the resistance mechanism 108A at the second end. The user 200 may then move into a squatting position, as shown in FIG. 7. As also shown in FIG. 7, the user 200 may grasp the support handle 102A fastened to the distal end of the collapsible member 102 for support during use. When in the squatting position, the resistance mechanism 108A may be partially engaged or unengaged by the user engagement member 120 (e.g., a lesser amount of resistance is being generated by the resistance band(s) 110 and/or the at least one tension coil 106,109 when the user 200 is in the squatting position).

The user 200 may move from the squatting position, as shown in FIG. 7, to a standing position, as shown in FIG. 8. When the user 200 moves into the standing position, the resistance mechanism 108A may be caused to be engaged by the user engagement member 120 and to move within the path of travel 104G of the standing platform 104 toward the first end 104A of the standing platform 104. In this way, engagement of the resistance mechanism 108A by the user engagement member 120 may generate an amount of resistance to enable the user 200 of the exercise apparatus 100 to exercise hip, abdominal, anterior, and posterior muscles (e.g., a greater amount of resistance is being generated by the resistance band(s) 110 and/or the at least one tension coil 106,109 when the user 200 is in the standing position).

The present description is intended to provide those of ordinary skill in the art with a complete description of how the articles, devices and/or methods claimed herein are made and evaluated, and are intended to be purely exemplary and are not intended to limit the scope of the described methods, systems, and apparatuses.

This description is not intended to limit the scope of the present methods, systems, and apparatuses. Unless otherwise expressly stated, it is in no way intended that any method set forth herein be construed as requiring that its steps be performed in a specific order. Accordingly, where a method claim does not actually recite an order to be followed by its steps or it is not otherwise specifically stated in the claims or descriptions that the steps are to be limited to a specific order, it is in no way intended that an order be inferred, in any respect. This holds for any possible non-express basis for interpretation, including: matters of logic with respect to arrangement of steps or operational flow or plain meaning derived from grammatical organization or punctuation.

It will be apparent to those skilled in the art that various modifications and variations may be made without departing from the scope or spirit. Other modifications and variations will be apparent to those skilled in the art from consideration of the specification and practice described herein. It is intended that the specification and descriptions therein be considered as exemplary only, with a true scope and spirit being indicated by the following claims.

What is claimed is:

1. An apparatus comprising:

a standing platform comprising a first end, a second end, a first side, a second side, and an open channel, wherein the open channel partially bisects the standing platform and is situated parallel to the first side and the second side;

a collapsible member comprising a distal end and a proximal end, wherein the proximal end of the collapsible member is situated at the first end of the standing platform;

a resistance mechanism, situated partially within the open channel and partially within an interior path of travel of the standing platform, wherein the resistance mechanism comprises a first plurality of elongate ends accessible at the open channel for mounting of a first resistance band and a second plurality of elongate ends accessible at the open channel for mounting of a second resistance band; and a user engagement member comprising a first portion for engaging hips of a user and a second portion for engaging the resistance mechanism, wherein engagement of the resistance mechanism causes the resistance mechanism to move within the interior path of travel toward the first end of the standing platform.

2. The apparatus of claim 1, wherein the user engagement member engages the resistance mechanism via a cord fastened to the second portion and the resistance mechanism.

3. The apparatus of claim 1, wherein the standing platform further comprises:

a first wheel fastened to the first side of the standing platform substantially near the second end of the standing platform; and a second wheel fastened to the second side of the standing platform substantially near the second end of the standing platform.

4. The apparatus of claim 1, wherein the collapsible member comprises a support handle fastened to the distal end of the collapsible member.

5. The apparatus of claim 1, wherein the proximal end of the collapsible member comprises a pivot point, and wherein the collapsible member may pivot at the proximal end toward the second end of the standing platform and be placed at least partially into the open channel of the standing platform.

6. The apparatus of claim 1, wherein the collapsible member further comprises a top portion at the proximal end and a bottom portion at the distal end, wherein the bottom portion may collapse into the top portion.

7. The apparatus of claim 1, further comprising a removable stance adjustment implement.

8. An apparatus comprising:

a standing platform comprising a first end, a second end, a first side, a second side, and an open channel, wherein the open channel partially bisects the standing platform and is situated parallel to the first side and the second side;

a collapsible member comprising a distal end and a proximal end, wherein the proximal end of the collapsible member is situated at the first end of the standing platform;

a resistance mechanism, situated partially within the open channel and partially within an interior path of travel of the standing platform, wherein the resistance mechanism comprises a first plurality of elongate ends accessible at the first side of the standing platform for mounting of a first resistance band and a second plurality of elongate ends accessible at the second side of the standing platform for mounting of a second resistance band; and a user engagement member comprising a first portion for engaging hips of a user and a second portion for engaging the resistance mechanism, wherein engagement of the resistance mechanism causes the resistance mechanism to move within the interior path of travel toward the first end of the standing platform.

9. The apparatus of claim 8, wherein the user engagement member engages the resistance mechanism via a cord fastened to the second portion and the resistance mechanism.

10. The apparatus of claim 8, wherein the collapsible member further comprises a mounting point for placement of the user engagement member, and wherein the placement of the user engagement member at the mounting point of the collapsible member partially engages the resistance mechanism and causes the resistance mechanism to move within the interior path of travel toward the first end of the standing platform and partially engage the first resistance band and the second resistance band.

11. The apparatus of claim 8, wherein the standing platform further comprises:

a first wheel fastened to the first side of the standing platform substantially near the second end of the standing platform; and a second wheel fastened to the second side of the standing platform substantially near the second end of the standing platform.

12. The apparatus of claim 8, wherein the collapsible member comprises a support handle fastened to the distal end of the collapsible member.

13. The apparatus of claim 8, wherein the proximal end of the collapsible member comprises a pivot point, and wherein the collapsible member may pivot at the proximal end toward the second end of the standing platform and be placed at least partially into the open channel of the standing platform.

14. The apparatus of claim 8, wherein the collapsible member further comprises a top portion at the proximal end and a bottom portion at the distal end, wherein the bottom portion may collapse into the top portion.

* * * * *